US005122640A

United States Patent [19]

Holmes

[11] Patent Number: 5,122,640

[45] Date of Patent: Jun. 16, 1992

[54] HEATING ELEMENT COIL SUPPORT

[75] Inventor: Ronald E. Holmes, Winneconne, Wis.

[73] Assignee: Nova Industries Inc., Oak Creek, Wis.

[21] Appl. No.: 584,069

[22] Filed: Sep. 18, 1990

[51] Int. Cl.[5] ..... H05B 3/06

[52] U.S. Cl. ..... 219/532; 219/536; 219/542; 174/138 J; 174/175; 338/304; 338/317; 338/318

[58] Field of Search ..... 219/532, 536, 542; 174/138 J, 175; 338/364, 318, 317

[56] References Cited

U.S. PATENT DOCUMENTS 3,846,619 11/1974 Wightman et al. ..... 174/138 J
4,250,399 2/1981 King ..... 174/138 J

*Primary Examiner*—Bruce A. Reynolds
*Assistant Examiner*—Michael D. Switzer
*Attorney, Agent, or Firm*—Andrus, Sceales, Starke & Sawall

[57] ABSTRACT

An insulating support for a helical wire heating coil for an electric resistance heating element includes a coil supporting notch into which a single helical coil turn is inserted and locked into position without twisting the coil and without unduly stretching the coil in an axial direction. The supporting notch includes lead-in ramp surfaces to spread the two halves of the coil turn until the coil is centrally positioned in the notch, whereupon the coil turn snaps into locking engagement with four separate abutments to prevent dislodgement. A central portion in the notch includes a separate coil supporting surface that limits further movement of the coil into the notch and the notch also includes interior lateral abutment surfaces to engage the outside of the coil turn and prevent lateral movement in the notch. The faces of the support body adjacent the notch are engaged by opposite half portions of the coil turn to preclude axial movement of the coil once it is locked in position.

20 Claims, 3 Drawing Sheets

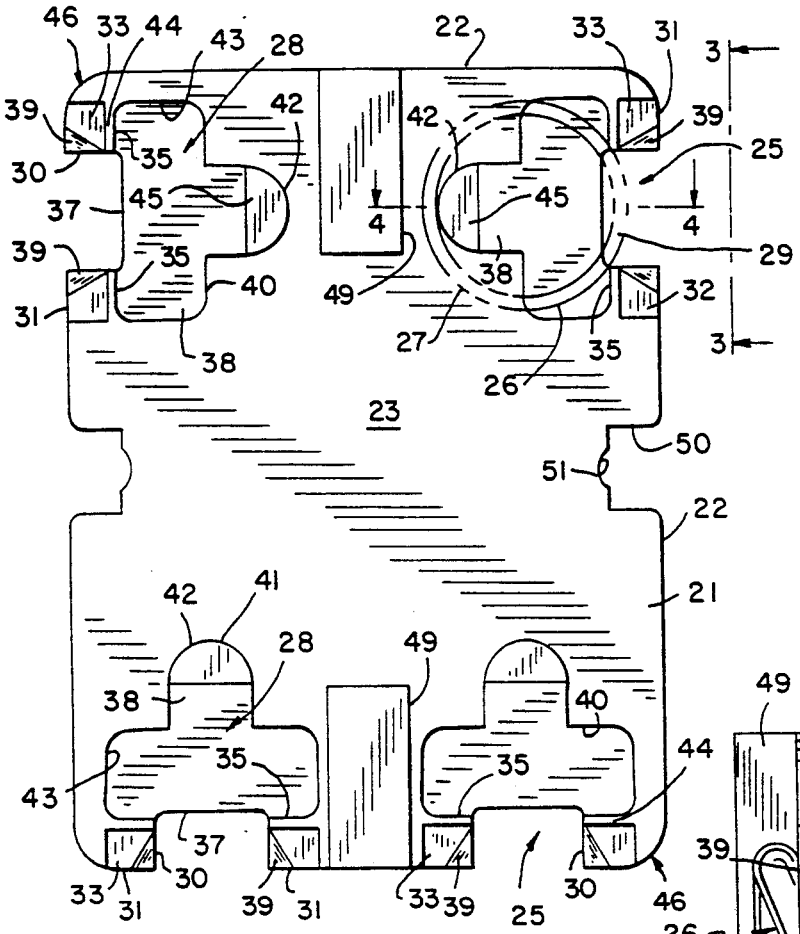
FIG. 2
FIG. 3
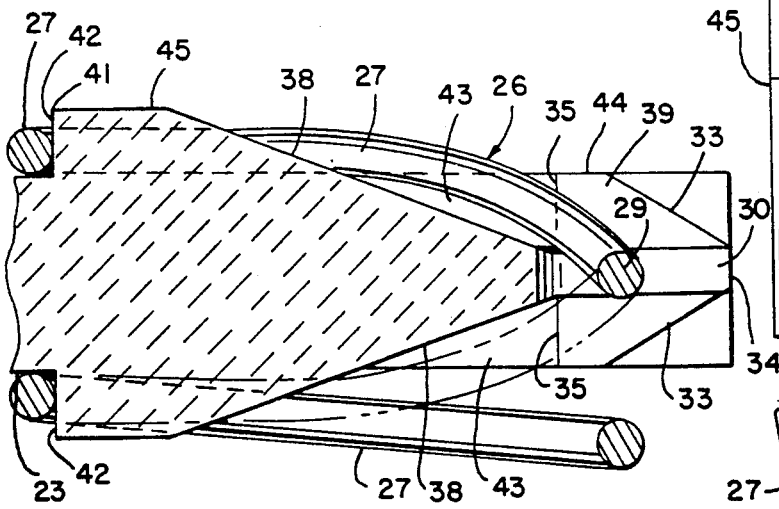
FIG. 4
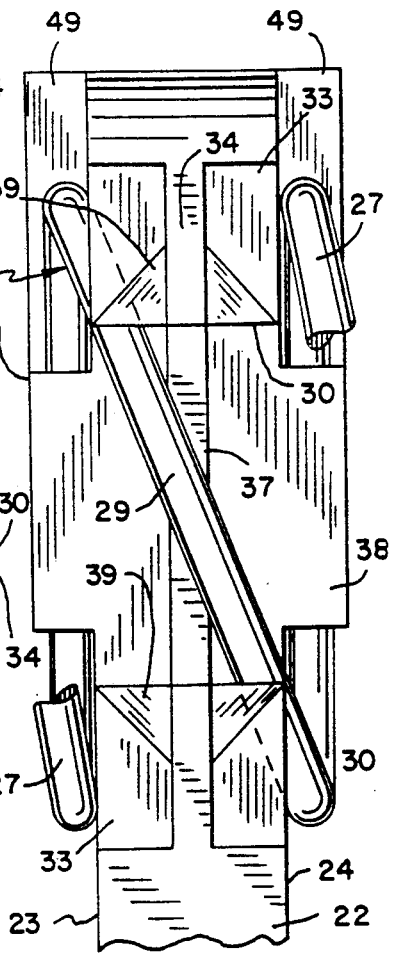

FIG. 6
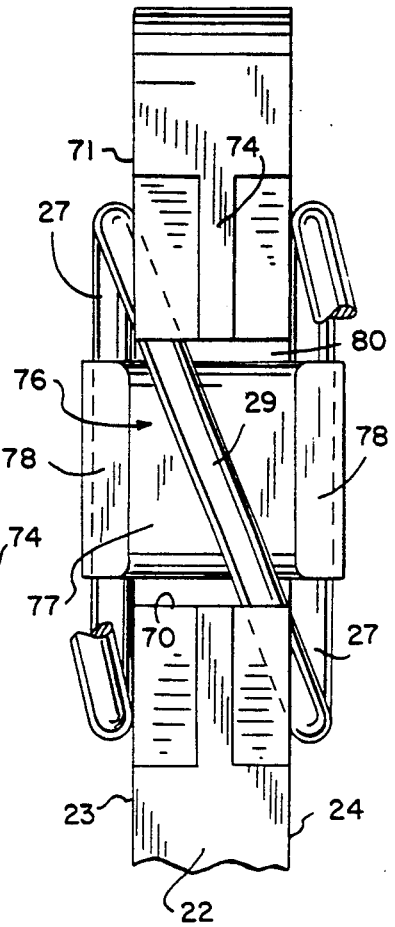
FIG. 7
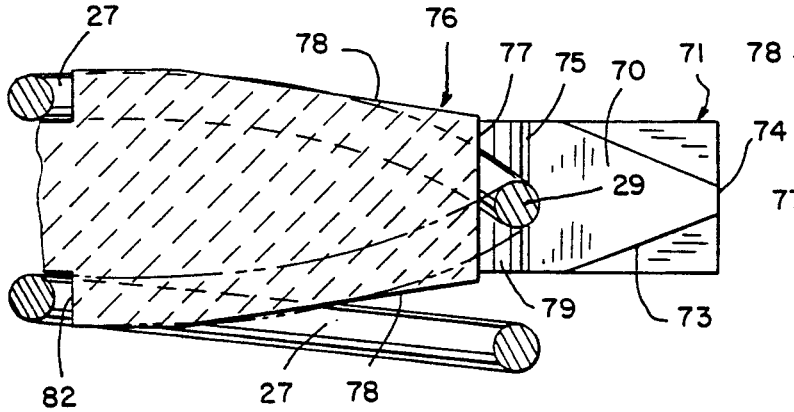
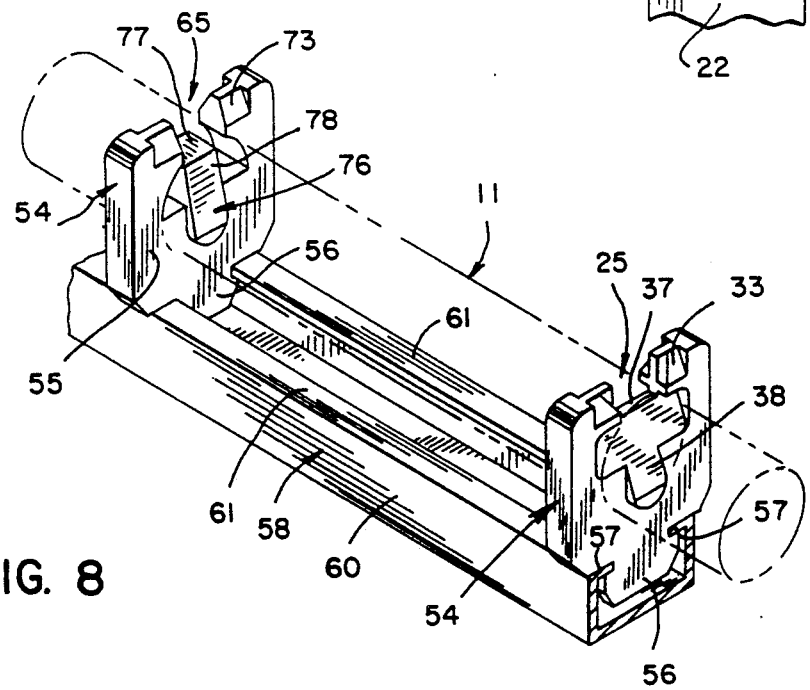
FIG. 8

HEATING ELEMENT COIL SUPPORT

BACKGROUND OF THE INVENTION

The present invention relates to electric resistance heating elements and, more particularly, to an insulating support for the helical wire coil used in such heating elements.

Electric heating elements utilizing helical wire heating coils are old and well known in the art. A helical wire heating coil is typically mounted on a supporting structure and strung between a number of ceramic insulating elements which provide direct support for the coil and space and isolate the coil from the supporting structure which is generally some type of metal framework. It is important that the insulating element hold the coil against both lateral displacement out of the supporting member and movement in the direction of the axis of the coil. Thus, it is common in prior art ceramic insulating supports to capture one or more turns of the helical coil to hold the same against lateral displacement and axial movement.

One common prior art support is typified by the constructions shown in U.S. Pat. Nos. Des. Nos. 261,260 and 262,285 and U.S. Pat. Nos. 4,363,959 and 4,692,599. In each of these Patents, a ceramic insulating support for the helical coil of a heating element includes a generally thin flat body with two or more hook-like notches on one or both ends. A few turns or convolutions of the coil are separated slightly and retained in the hook-like notches by the inherent resilience of the coil. The axis of the coil extends generally parallel to the thin flat body of the insulator with adjacent turns of the coil held in oppositely facing notches. To attach the coil to these supports, the coil must be stretched axially and/or twisted rather severely from its axial direction, resulting in the possibility of stretching the wire beyond its yield point and causing a permanent deformation in the coil.

Another somewhat similar insulating support is shown in U.S. Pat. No. 4,250,399. This insulator also has a relatively thin flat ceramic body with a single coil supporting notch centered in one edge. The notch extends generally perpendicular to the flat body and supports the coil with its axis also perpendicular to the body (or generally at 90 degrees from the coil axis in the constructions previously described). The edge of the insulator body on both sides of the notch is provided with downwardly opening lips which engage the coil turns on each face of the body to prevent the coil from being withdrawn after attachment. In order to attach the coil to the insulator body, however, it must be turned so that the coil axis is at 90 degrees to its final position in order to insert one turn of the coil into the slot. This assembly procedure also has the potential for causing permanent distortion of the coil and, where multiple supports are used to mount a long heating coil as is customary, the procedure for mounting the coil on the entire supporting framework can be tedious and time consuming, as well.

The insulating supports of the prior art typically include a body with a single notch in one edge or an elongate body having oppositely opening notches in opposite edges. The supporting structure for mounting the coil-carrying supports may comprise a formed sheet metal structure or circular cross section wire rods. Generally, a single long helical coil extends in multiple parallel passes, generally four, over the supporting framework and the two ends of the coil are attached to a conventional electric terminal for connection to a source of electric current.

It would be most desirable to have an insulating support for a helical wire heating coil to which the coil may be attached without bending or twisting the coil off of its longitudinal axis, but which allows the coil to be attached easily and without permanent distortion, and which retains the coil against either axial or lateral movement.

SUMMARY OF THE INVENTION

In accordance with the present invention, an insulating support for a helical wire heating coil includes a coil supporting notch in one edge of the body into which the coil maybe snapped with a minimum of distortion and without any axial twisting or displacement. The notch is adapted to receive approximately a single coil turn and includes a number of separate abutment shoulders which engage different portions of the coil turn to provide positive retention of the coil against displacement. The ceramic body may be provided with one or a plurality of coil supporting notches and may be adapted for attachment to a supporting structure in any of the manners commonly used in the art.

In a preferred embodiment, the rigid insulating body of the support has a generally rectangular shape including relatively thin outer edge portions between generally flat front and rear faces. A plurality of coil support notches are formed in one or more of the outer edge portions and each of the notches is adapted to receive approximately a single turn of the coil such that a portion of the coil turn is positioned adjacent the front and rear faces of the body and the axis of the coil extends perpendicular thereto. Each of the coil supporting notches includes an interior portion that has a major dimension larger than the outside diameter of the coil. The interior portion of the notch includes a specially shaped surface to provide clearance for the portion of the coil turn or the interior portion may have a substantially open construction. The notch also includes a coil entry slot comprising a pair of spaced shoulders which define the notch opening. The entry slot has a length along the outer edge of the body and between the spaced shoulders which is smaller than the outside diameter of the coil. Each of the shoulders is provided with a first entry ramp comprising a pair of inwardly divergent first ramp surfaces which aid in spreading adjacent coil turns as the coil is pushed into the notch. Each of the shoulders includes an outer coil abutment shoulder adapted to engage the outer surface of the coil turn after the coil has been inserted past the first entry ramp to lock the coil in place. A central support is disposed in the bottom of each notch and provides a coil support edge or surface. The support also includes a pair of second ramp surfaces which diverge inwardly from opposite edges of the coil support edge or surface. The second ramp surfaces extend along the front and rear faces of the body and terminate in inner edges which are spaced from the faces of the body. The inner edges of the second ramps surfaces form, with the front and rear faces, a pair of inner abutment shoulders which engage the inner surface of opposite portions of the coil turn to also lock the coil in place. The coil support edge or surface on the central support engages the inside surface of the coil turn opposite the inner abutment shoulders to prevent the coil from moving further into the notch, thereby fixing the coil axis positively against lateral movement once locked in place.

In a preferred embodiment, the body of the support is generally square and includes four notches distributed approximately equally around the outer edge. Each of the insulating support bodies is provided with a pair of grooves on opposite edges to receive sheet metal bands forming a part of the heating element supporting structure.

BRIEF DESCRIPTION OF THE DRAWINGS

FIG. 2 is an enlarged front elevation of one of the supports of the present invention showing generally the position of a helical wire heating coil mounted thereon.

FIG. 3 is an enlarged partial view of the edge of the support of the present invention taken on line 3—3 of FIG. 2.

FIG. 4 is an enlarged partial section taken on line 4—4 of FIG. 2.

FIG. 5-7 are views similar to FIGS. 2-4, respectively, showing details of an alternate construction of the insulating coil support.

FIG. 8 is a perspective view of a portion of a heating element showing another embodiment of the heating coil support of the present invention.

DETAILED DESCRIPTION OF THE PREFERRED EMBODIMENT

Figure 1:
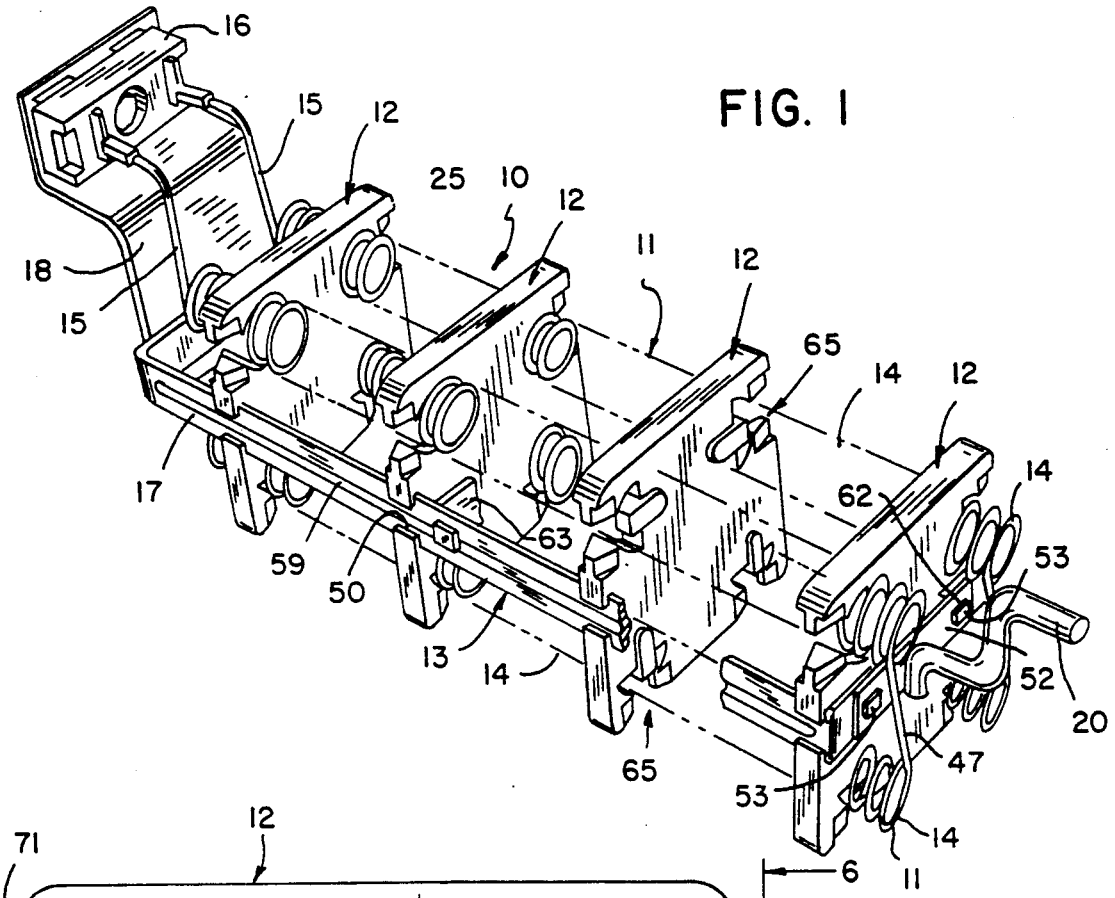
FIG. 1 is a prospective view of a heating element utilizing the support members of the present invention.

Referring initially to FIG. 1, a heating element 10 includes a conventional helical wire resistance heating coil 11 mounted in a plurality of insulating supports 12 of the present invention, which supports are in turn held in a generally parallel spaced relation by a supporting structure 13. The heating coil 11 is of a continuous length and is disposed in four generally parallel coil sections 14 with the ends 15 of the coil wire attached to a conventional terminal block 16 for connection to a source of electric current. The supporting structure 13 comprises a thin metal band 17 wrapped around and in engagement with each of the insulating supports 12 in a manner to be described in greater detail hereinafter. A thin metal tongue 18 supporting the terminal block 16 is attached to the supporting metal band 17 at one end and a support rod 20 is welded to the other end of the metal band to facilitate mounting the heating element in an appliance.

Each of the insulating supports 12 of the present invention comprises, in a preferred embodiment, a relatively thin rectangular or nearly square body 21 having narrow edge portions 22 between parallel front and rear faces 23 and 24, respectively.

Four coil support notches 25 are formed in the edge portions 22 and are generally equally distributed around the perimeter of the body 21. In the embodiment shown, two notches 25 are formed in one edge portion 22 and a single notch is formed in the remote end of each edge portion 22 adjacent that containing the two notches. Of course, other notch patterns and body shapes could be utilized to accommodate more or less coil sections 14, as desired. Each of the support notches 25 is adapted to receive approximately a single turn 26 of a helical coil section 14 and to support and lock the coil section against axial movement or lateral movement in the notch. The approximate single coil turn 26 or coil convolution which is supported in the notch 25 is best seen with reference to FIGS. 2-4. The supported coil turn 26 comprises just slightly more than a full 360 degree turn of the helical coil and includes two identical coil turn portions 27, one positioned against each of the front and rear faces 23 and 24 of the body, which turn portions 27 are integrally joined at the outer transition point 29 between the coil turn portions.

Each coil support notch 25 has an interior portion 28 which, in the embodiment of FIGS. 2-4 is generally rectangular in shape with rounded curves. The major dimension of the interior portion 28 is just slightly larger than the outside diameter of the coil section 14. The interior portion 28 of the notch opens to the edge portion 22 in a coil entry slot 30 which is bounded at the edge by a pair of spaced shoulders 31. The entry slot 30 has a length along the outer edge portion 22 and between the shoulders 31 which is smaller than the outside diameter of the coil section 14.

Each of the shoulders 31 includes a first coil entry ramp 32 which includes a narrow outer edge 34 and a pair of inwardly divergent first ramp surfaces 33. The first ramp surfaces slope from the narrow edge 34 generally toward the front and rear faces 23 and 24 of the body. The interior surfaces of the shoulders 31 on the inside of the notch form a pair of spaced outer coil abutment shoulders 35 which are adapted to engage the outer surface of the coil turn adjacent the juncture or transition point 29 of the coil turn portions 27 when the coil is fully inserted into the notch. The outer abutment shoulders 35 provide the first means for securing the coil against lateral displacement out of the notch.

The interior portion 28 of the notch 25 terminates outwardly at the coil entry slot 30 in a narrow intermediate coil support edge 37. The coil support edge 37 is adapted to engage the inner surface of the center 29 of the coil turn 26 immediately below the outer abutment shoulders 35 to keep the coil section 14 centered in the notch and prevent it from sliding further inwardly.

The interior portion of the notch also includes a pair of oppositely disposed second ramp surfaces 38 which are inwardly divergent from opposite sides of the coil support edge 37. The second ramp surfaces extend along the notch interior and continue inwardly past the inner edge 40 of the notch interior to extend a short distance over the front and rear faces 23 and 24, respectively, of the support body 21. The second ramp surfaces 38 terminate inwardly in curved inner edges 41 which are spaced from the flat faces of the body and define therewith a pair of cylindrical inner abutment shoulders 42. These inner abutment surfaces are adapted to engage the inner surface of each of the coil turn portions 27 disposed against one of the faces 23 or 24 of the support element body when the coil is fully inserted into the notch to present a second positive barrier against lateral displacement of the coil section out of the notch.

The second ramp surfaces 38 also extend laterally in both directions from the ends of the coil support edge 37 along the underside of the shoulders 31 forming undercut regions which define the outer abutment shoulders 35. Specifically, each outer abutment shoulder is divided in two by the intersection of the ramp surfaces 38 and the undersides of the shoulders.

When a coil section 14 is mounted in the support notch 25, the axis of the coil extends generally perpendicular to the faces 23 and 24 of the body 21. The unique configuration of the notch 25 allows the coil section to be attached without any twisting or bending of the coil section out of its axial orientation. Referring particularly to FIGS. 3 and 4, as the coil section 14 is moved in a direction inwardly with respect to the notch 25, two adjacent coil turn portions 27 will straddle the narrow edges 34 on opposite sides of the entry slot 30 and engage the first ramp surfaces 33. As the coil section is pushed inwardly, the coil turn portions 27 will be forced axially apart, causing the pitch angle of that coil turn to increase. In other words, the coil turn wire integrally connecting the two opposite coil turn portions 27 and forming the transition 29 therebetween is moved to an ever increasing acute angle with respect to the front and rear faces 23 and 24 as the coil turn rides inwardly over the first ramp surfaces 33 until the transition portion fits (in diagonal fashion as viewed in FIG. 3) through the coil entry slot 30.

As soon as the innermost ends of the coil turn portions 27 pass inwardly beyond the first ramp surfaces 33 they come into engagement with the second ramp surfaces 38 on the interior portion 28 of the notch. The width of the support edge 37 is substantially less than the spacing to which the coil turn portions have already been spread by the first range surfaces 33 and therefore, the coil turn will begin to pass without obstruction over the edge 37 and second ramp surfaces 38. As previously indicated, the second ramp surfaces 38 diverge inwardly and away from the opposite front and rear faces of the body. This results in a further spreading of the inner ends of the coil turn portions 27, as they move inwardly along the notch, until they reach the curved inner edges 41 of the second ramp surfaces, whereupon the resilience of the coil causes the coil turn to snap over the inner abutment surfaces 42 and against the opposite front and rear faces 23 and 24 to lock the coil in the notch. The positions of the inner abutment surfaces 42 are chosen such that, simultaneously with the inner ends of the coil turn snapping into locking position, the outer central juncture 29 of the coil turn passes the first ramp surfaces and snaps under the outer abutment shoulders 35.

When the coil has been fully inserted into the notch, the single coil turn 26 is captured and locked at four points, namely, each of the inner abutment surfaces faces 42 and diagonally opposite corners of the outer abutment shoulders 35. In addition, the inside of the coil turn at the central juncture or transition 29 engages the coil support edge 37 to prevent the coil from moving further into the notch 25 beyond its centered position. Each of the coil turn portions 27 locked against an inner abutment surface 42 also lies against one of the faces 23 or 24 of the body, thereby preventing axial movement of the coil section 14. Lateral movement of the coil section within the slot in a direction parallel to the inner edge 40 thereof is inhibited by engagement with the small triangular abutments 43 formed in the opposite lateral faces of the interior 28 of the notch by the intersection therewith of the second ramp surfaces 38. However, because axial deflection of the coil might cause the coil turn to override a triangular abutment 43, separate spacer blocks 49 may be formed in the insulator body between adjacent notches to positively prevent contact between coil sections 14.

In the embodiment shown, the first ramp surfaces 33 terminate inwardly short of the outer abutment shoulders 35 to define therebetween short flat portions 44. Similarly, the second ramp surfaces 38 terminate short of the curved inner edges 41 to define small semi-circular flats 45. The flat portions 44 and semi-circular flats 45 are merely for convenience of construction and are not necessary for proper functioning of the insulating support 12. However, the semi-circular flats 45 at the inner ends of the second ramp surfaces 38 facilitate stacking during manufacture and help limit the amount by which opposite portions of the coil turn 26 are spread axially during installation, thereby helping prevent deflection beyond the yield point and permanent deformation of the coil turn.

To help facilitate movement of the outer transition region 29 of the coil turn through the coil entry slot 30, the four corners of the shoulders 31 at the intersections of the first ramp surfaces 33 and the narrow edge 34 may be provided with small faceted surfaces 39. The faceted surfaces 39 eliminate corners which would otherwise require a larger angular deflection of the transition region 29 before it would pass through the coil entry slot and, therefore, a larger overall axial deflection of the coil.

The four point coil locking feature described above provides a certain redundancy which is important to retain the coil in a locked position in the event of damage to the insulating support body 21 or deformation of the coil section 14. For example, it is known that the ceramic material from which insulating supports 12 are typically made is relatively brittle and may break if struck with a sufficiently hard blow. In particular, the thinner sections of the body are especially susceptible to fracture. Thus, one of the ears 46 at the corner of the body forming one of the first entry ramps 32 and outer abutment shoulders 35 could be accidentally broken off. Under such circumstances, the coil section 14 would still be held in place by the inner abutment shoulders 42 and the remaining outer abutment shoulder 35. Similarly, inadvertent axial stretching of the coil section 14 could result in permanent distortion causing the inner ends of the coil turn portions 27 to move away from the faces of the body and out of engagement with the inner abutment shoulders 42. In such a situation, it is likely that the outer portion of the coil turn would still remain in engagement with the outer abutment shoulders 35, thereby preventing lateral displacement of the coil section from the support notch 25.

Figure 5:
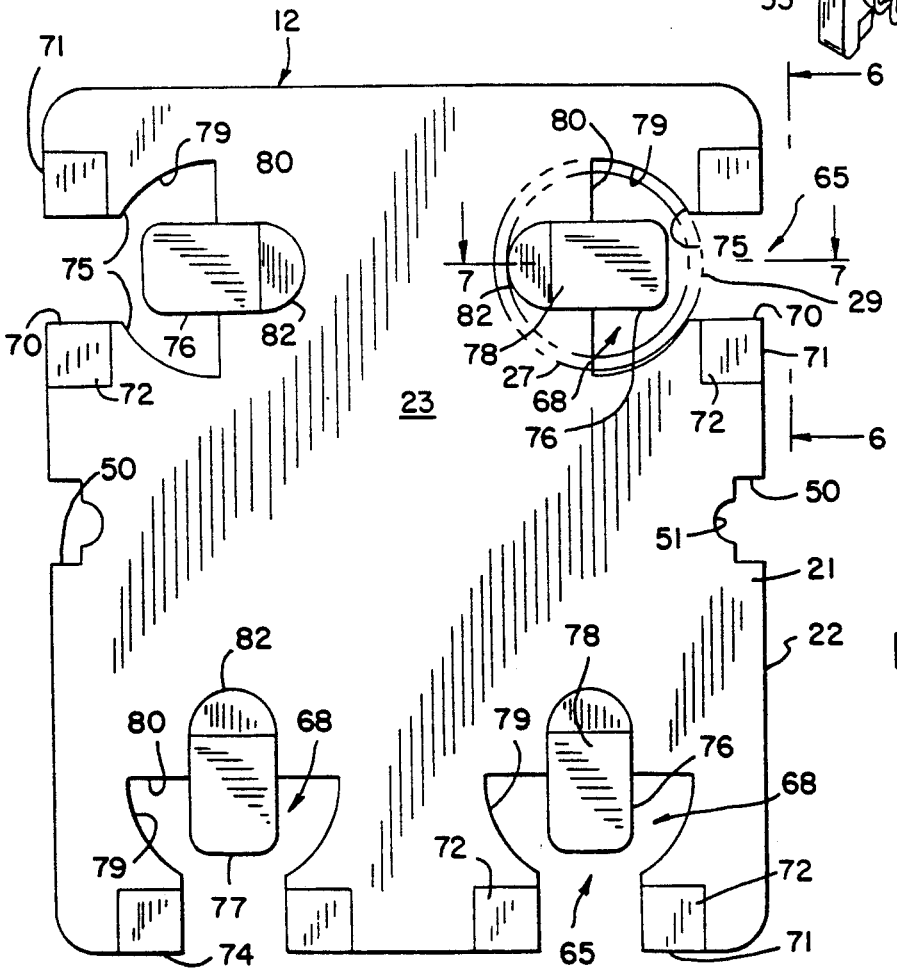

Referring now to FIGS. 5–7, an alternate embodiment of an insulating support 12 is shown. The support may include a body 21 identical to the embodiment shown in FIGS. 2–4 with the only difference being in the construction of the coil support notches. Each support notch 65 in this embodiment is very similar to the notches 25 of the preferred embodiment. Thus, each notch 65 includes a pair of oppositely disposed shoulder 71 defining therebetween an entry slot 70. The shoulders are also provided with first ramp surfaces 72 which extend inwardly from a narrow outer edge 74. The interior portion 68 of the notch 65 is substantially open and is defined largely by a flat inner surface 80 and a semi-cylindrical outer surface 79. The semicylindrical surface 79 is centrally interrupted by the entry slot 70. The inner surfaces of the shoulders 71 adjacent the entry slot define the outer abutment shoulders 75, also similar to those of the preferred embodiment.

Extending outwardly from the flat inner surface 80 of the interior portion of the notch is a centrally disposed pedestal 76 which terminates short of the coil entry slot 70 in a generally flat coil support surface 77. The coil support surface 77 is adapted to engage the inner surface of the center transition 29 of the coil turn to keep the coil section 14 centered in the notch and to prevent it from being displaced too far inwardly. In this manner, the flat coil support surface 77 functions similarly to the coil support edge 37 of the preferred embodiment described above.

The pedestal 76 also includes a pair of oppositely disposed second ramp surfaces 78 which diverge inwardly from opposite edges of the coil support surface 77. The second ramp surfaces 78 extend along opposite sides of the pedestal and continue inwardly past the flat inner surface 80 to extend a short distance over the front and rear faces 23 and 24 to terminate in inner abutment surfaces 82 identical to those of the previously described embodiment.

The semi-circular surfaces 79 extending away from the outer abutment shoulder 75 on the interior of the notch prevent lateral movement of the coil section within the slot in a direction parallel to the flat inner surface 80. Installation of a coil section 14 into a notch 65 and the four point system by which the coil section is locked in the notch is virtually identical to the function of the notch 25 of the preferred embodiment. The open interior portion 68 of the notch 65 may provide for a more efficient flow of heat-dissipating air through the heating element, but the smoother closed construction of the interior portion 28 of the notch 25 of the preferred embodiment is believed to be somewhat stronger against both physical and thermal shocks.

Referring again to FIG. 1, the heating coil 11 is formed from a single continuous wire wound into four coil sections 14 each of which is supported along its length in the support notch 25 of four spaced insulating supports 12. The end of each coil section 14, except for the ends 15 connected to the terminal block 16, includes an integral tangent section 47 connecting adjacent coil sections. In the illustrated embodiment, there are two such tangent sections 47 at the end of the element including the support rod 20 and one tangent section 47 (not shown) at the opposite end of the element. Each of the insulating support bodies 21 includes a pair of mounting grooves 50 in opposite edge portions 22 for receipt of the metal band 17 of the supporting structure 13. The mounting grooves 50 may be shaped in any convenient manner, including a semi-circular center depression 51 to accommodate a metal band 17 having a continuous longitudinal reinforcing rib 59. The ends of the encircling metal band 17 may be attached with a suitable connecting link 52 having slots 62 for receiving bent tabs 53 from adjacent ends of the band. The support rod 20 is preferably welded or otherwise attached directly to the connecting link 52. On the opposite end of the element, the metal band 17 may be continuous or may utilize the metal tongue as a connecting link with tab connections 53 in the same manner described for the support rod end. To provide added rigidity to the heating element, the supporting structure 13 may also include an intermediate brace 63 extending between the metal band 17 on opposite sides of the element between, for example, the two center supporting bodies and between the upper and lower pairs of coil sections. Such an intermediate brace may be attached by bent tabs 53 extending through slots in the metal band 17 or welded, as desired. The intermediate brace 63 also prevents spreading of the metal support bands 17 on opposite sides of the element which might otherwise result in a band being dislodged from a mounting groove 50. However, if the grooves 50 are made sufficiently deep, dislodgement of the bands may be avoided.

In FIG. 8, there is shown a pair of unitary insulating supports 54 each of which includes a single support notch 25 or 65. The support notch is identical in every respect to the notches of the preferred embodiment and will, therefore, not be further described. The body 55 of the unitary support 54 is substantially smaller and includes an integral lower mounting tab 56 provided with a pair of opposite mounting slots 57. The mounting slots 57 are adapted to utilize a supporting structure 58 comprising a channel section 60 having oppositely disposed end flanges 61 sized and positioned to be received in the mounting slots 57 of the unitary support 54. The heating coil section 14, shown only in phantom, is otherwise inserted and locked into the supporting notches 25 in the manner previously described.

Various modes of carrying out the present invention are contemplated as being within the scope of the following claims particularly pointing out and distinctly claiming the subject matter which is regarded as the invention.

I claim:

1. An insulating support for a helical wire heating coil comprising:

a rigid body of insulating material, said body having a relatively thin outer edge portion between generally flat parallel front and rear faces;

a support notch having an opening in the outer edge portion, said notches adapted to receive approximately a single turn of the coil with a portion of the coil turn disposed adjacent each of said front and rear faces and the coil axis disposed generally perpendicular to said front and rear faces;

said support notching having inner abutment means for engaging the inner surface of said coil turn portion and outer abutment means inwardly of said outer edge portion for engaging the outer surface of said coil turn adjacent the juncture of said coil turn portions.

2. The apparatus as set forth in claim 1 including support means centrally positioned in said notch between said inner and outer abutment means for engaging the inner surface of said coil turn adjacent the juncture of said coil turn portions.

3. The apparatus as set forth in claim 2 wherein said inner abutment means comprises an inner abutment shoulder on each of said front and rear faces.

4. The apparatus as set forth in claim 3 wherein said support means is formed integrally with said inner abutment shoulders.

5. The apparatus as set forth in claim 1 wherein said support notch further comprises:

an interior portion having a major dimension larger than the outside diameter of the coil; and, a coil entry slot defining said notch opening, said entry slot having a length along the outer edge of said body smaller than the outside diameter of the coil.

6. The apparatus as set forth in claim 5 wherein said outer abutment means comprises an outer abutment shoulder on each side of said entry slot.

7. The apparatus as set forth in claim 6 including first coil entry ramps on the outer edge portion of said body on each side of said entry slot, each of said first entry ramps including a narrow outer edge and a pair of inwardly divergent first ramp surfaces.

8. The apparatus as set forth in claim 7 wherein said first ramp surfaces extend inwardly from said outer edge to said outer abutment shoulder.

9. The apparatus as set forth in claim 4 wherein said support means comprises an intermediate coil support edge and a pair of second ramp surfaces on opposite sides of said intermediate edge, said second ramp surfaces being inwardly divergent and extending between said intermediate edge and said inner abutment shoulders.

10. The apparatus as set forth in claim 4 wherein the interior portion of said notch is generally open and includes said outer abutment shoulders.

11. The apparatus as set forth in claim 10 wherein said open interior portion is generally semi-circular.

12. The apparatus as set forth in claim 11 wherein said support means comprises a pedestal centrally positioned in said notch, said pedestal having a coil support surface and a pair of second ramp surfaces on opposite sides of said pedestal, said second ramp surfaces being inwardly divergent and extending generally between said coil support surface and said inner abutment shoulders.

13. An insulating support for a helical wire heating coil comprising:

a generally rectangular body of insulating material having relatively thin outer edge portions between generally flat front and rear faces;

a plurality of coil support notches formed in at least one of said outer edge portions, each of said notches adapted to receive approximately a single turn of the coil with a portion of the coil turn disposed adjacent said front and rear faces and with the axis of the coil extending perpendicular to said faces;

each of said notches including an interior portion having a major dimension larger than the outside diameter of the coil, a coil entry slot including a pair of spaced shoulders defining said notch opening, said slot having a length along said outer edge portion and between said shoulders smaller than the outside diameter of the coil;

a first entry ramp on each of said shoulders, said first entry ramp including a narrow outer edge and a pair of inwardly divergent first ramp surfaces;

an outer coil abutment shoulder on the inside of each spaced shoulder;

support means centrally disposed in the bottom of each notch, said support means including an intermediate coil support edge adjacent said coil entry slot and said outer abutment shoulders;

said support means including a pair of second ramp surfaces inwardly divergent from said coil support edge, said second ramp surfaces extending along said front and rear faces of said body and terminating in inner edges spaced therefrom; and, a pair of inner abutment shoulders defined by the inner edges of said second ramp surfaces and said front and rear faces.

14. The apparatus as set forth in claim 13 wherein said body of insulating material is generally square and includes four support notches approximately equally distributed around said outer edge portions.

15. The apparatus as set forth in claim 14 wherein said support notches comprise a pair of notches in one edge portion and a single notch in the remote end of each edge portion adjacent said one edge portion.

16. The apparatus as set forth in claim 13 comprising structural support grooves in one pair of opposite edge portions of said body.

17. The apparatus as set forth in claim 14 including spacer means on the front and rear faces of said body between each pair of notches for preventing contact between coils supported in each of said pair of notches.

18. An insulating support apparatus for a helical wire heating coil comprising:

a plurality of insulator bodies, each having a generally rectangular shape and including relatively thin outer edge portions and generally flat opposite faces;

a pair of coil support notches formed in at least one outer edge portion of each insulator body, each of said notches adapted to receive approximately a single turn of the coil with a portion of the coil turn positioned adjacent the flat opposite faces of the body and with the axis of the coil extending perpendicular to said faces;

said insulator bodies positioned in spaced parallel relation along the coil with similarly positioned notches in each body aligned on the coil axis;

each of said notches including a coil entry slot having an opening in the outer edge smaller than the outer diameter of the coil and an interior having a major dimension larger than the outside diameter of the coil; and, each of said notches further including ramp means for axially opening said coil turn in response to lateral movement of the coil into said notch while the coil axis is maintained generally perpendicular to said faces, and abutment means for engaging diametrically opposite inner and outer portions of said coil turn and locking the coil in said notch.

19. The support apparatus as set forth in claim 18 including an insulator body support structure comprising:

a thin metal supporting band encircling said spaced parallel insulator bodies, said band engaging opposite edge portions of each body and extending across one face of each endmost body of the spaced parallel bodies; and, mounting grooves in said opposite edge portions for receipt of said metal band.

20. The support apparatus as set forth in claim 19 wherein said metal supporting band comprises:

a long band portion on each side of said spaced parallel bodies;

link means extending across said faces of each endmost body for interconnecting the ends of said band portions; and, fastening means for attaching the ends of said band portions to said link means.

* * * * *